US008191333B2

(12) United States Patent
Braun

(10) Patent No.: US 8,191,333 B2
(45) **Date of Patent: *Jun. 5, 2012**

(54) PANEL, IN PARTICULAR A FLOOR PANEL

(75) Inventor: Roger Braun, Willisau (CH)
(73) Assignee: Flooring Technologies Ltd., Pieta (MT)

( * ) Notice: Subject to any disclaimer, the term of this patent is extended or adjusted under 35 U.S.C. 154(b) by 0 days.

This patent is subject to a terminal disclaimer.

(21) Appl. No.: 13/302,515
(22) Filed: Nov. 22, 2011

(65) Prior Publication Data

US 2012/0067461 A1 Mar. 22, 2012

Related U.S. Application Data

(63) Continuation of application No. 12/440,137, filed as application No. PCT/EP2008/007328 on Sep. 8, 2008, now Pat. No. 8,099,924.

(30) Foreign Application Priority Data

Sep. 10, 2007 (DE) ..... 10 2007 042 840

(51) Int. Cl.
*E04B 1/00* (2006.01)

(52) U.S. Cl. ..... 52/745.19; 52/390; 52/539; 52/588.1; 428/50

(58) Field of Classification Search ..... 52/588.1, 52/582.1, 582.2, 587.1, 586.1, 586.2, 585.1, 52/578, 390, 392, 533, 534, 539, 553, 589.1, 52/590.2, 590.3, 591.1, 591.2, 591.3, 591.4, 52/591.5, 592.1, 582.4, 745.07, 745.19, 747.1, 52/747.11, 748.1, 748.11; 403/334, 345, 403/364–368, 372, 375, 376, 381; 404/34, 404/35, 40, 41, 46, 47, 49–58, 68, 70; 428/44, 428/47–50, 57, 58, 60, 61, 106, 192–194
See application file for complete search history.

(56) References Cited

U.S. PATENT DOCUMENTS

2007/0130872 A1 6/2007 Goodwin et al.
2008/0134607 A1 6/2008 Pervan et al.
2008/0241440 A1 10/2008 Bauer

FOREIGN PATENT DOCUMENTS

DE 201 12 474 12/2002

(Continued)

OTHER PUBLICATIONS

International Search Report for corresponding International Application No. PCT/EP2008/007328.

*Primary Examiner* — William Gilbert
(74) *Attorney, Agent, or Firm* — Andrew M. Calderon; Roberts Mlotkowski Safran & Cole, P.C.

(57) ABSTRACT

A method of forming a panel having a core of a wood material or wood material/plastic mixture and a top side and an underside is provided. The method includes forming a profile corresponding to one another on at least a first side edge and a second side edge lying opposite one another. The method further includes forming a hook connection with an upper locking section having a hook element and a lower locking section having a hook element which effects the locking in the horizontal direction, and forming at least one spring element movable in the horizontal direction which effects the locking in the vertical direction (V). The at least one spring element is free in the direction of the first side edge lying opposite by an essentially vertical slot. In the method of manufacturing, the panel is moved at a constant speed when the essentially vertical slot is formed.

23 Claims, 6 Drawing Sheets

FOREIGN PATENT DOCUMENTS

| | | |
|---|---|---|
| DE | 102 24 540 | 12/2003 |
| DE | 102 31 921 | 1/2004 |
| DE | 103 05 695 | 9/2004 |
| EP | 1 650 375 | 10/2004 |
| FR | 2 826 391 | 12/2002 |
| WO | 2004/003314 | 1/2004 |
| WO | 2007/020088 | 2/2007 |
| WO | 2008/110112 | 9/2008 |
| WO | 2008/116623 | 10/2008 |

PANEL, IN PARTICULAR A FLOOR PANEL

CROSS REFERENCE TO RELATED APPLICATIONS

The present application is a continuation application of copending application Ser. No. 12/440,137, filed on Jun. 22, 2009, which is a national stage filing under 35 U.S.C. 371 of PCT/EP2008/007328, filed on Sep. 8, 2008, all of which claim priority to German application serial no. 10 2007 042 840.7, filed on Sep. 10, 2007, the contents of each being incorporated by reference herein in their entireties.

BACKGROUND OF THE INVENTION

1. Field of the Invention

The invention relates to a panel, in particular a floor panel, with a core of a wood material or wood material/plastic mixture, a top side and an underside, wherein the panel has a profile corresponding to one another on at least two side edges lying opposite one another, such that two identically embodied panels can be joined and locked to one another through an essentially vertical joining movement in the horizontal and vertical direction. The locking in the horizontal direction can be effected by a hook connection with an upper locking section having a hook element and a lower locking section having a hook element. The locking in the vertical direction can be effected by at least one spring element that can be moved in the horizontal direction and during the joining movement the at least one spring element snaps in behind a locking edge extending essentially in the horizontal direction.

2. Discussion of Background Information

A panel with a locking in the vertical direction is known, for example, from EP 1 650 375 A1. This type of locking realized with this panel is preferably provided on the transverse side of floor panels. However, it can also be provided on the long side or on the long side as well as on the transverse side. The spring element is composed of plastic and is placed in a groove running horizontally on one of the side edges and chamfered on its top side. Similar to a door latch, through the chamfer the spring element is pressed inwards into the groove by the panel to be newly placed, when the underside thereof meets the chamfer and is lowered further. When the panel to be newly placed is completely lowered onto the base, the spring element snaps into a groove inserted horizontally in the opposite side edge and locks the two panels in the vertical direction. Special injection molds are necessary for the production of this spring element, so that the production is relatively expensive. Furthermore, a high-quality plastic must be used in order to provide sufficient strength values, which makes the spring element even more expensive. If plastics are used with strength values that are too low, this leads to relatively large dimensions of the spring elements, since only thereby is it ensured that corresponding forces can be generated or transferred.

Additional expenses result because the locking element is embodied as a separate component. The production of the locking element is carried out for technological reasons spatially separately from the panels, so that an integration into the continuous production process, in particular for floor panels, is likely to be impossible. Through the different materials, wood material on the one hand and plastic on the other hand, the adjustment of production tolerances from two separate production processes is complex and cost-intensive. Since the locking in the vertical direction would be ineffective if the locking element was missing, in addition this must be secured from falling out of the groove inserted in the side edge in the further production process and during transport. This securing is also complex. Alternatively thereto, the locking element could be made available to the consumer separately.

The floor panels under consideration are being laid with increasing frequency by do-it-yourselfers, so that, in principle, it is possible due to a lack of experience for the required number of locking elements to be initially miscalculated and not obtained in sufficient quantity in order to be able to lay a room completely. Furthermore, it cannot be ruled out that the do-it-yourselfer upon placing the spring element makes a mistake that means that precise locking is not possible and the bond separates over time, which is then wrongly attributed by the consumer to the quality supplied by the manufacturer.

A panel is known from DE 102 24 540 A1, which is profiled on two side edges lying opposite one another such that hook-shaped connection elements are formed for locking in the horizontal direction. For locking in the vertical direction, positive engagement elements spaced apart from one another horizontally and vertically are provided on the connection elements and undercuts corresponding thereto are provided with respectively one horizontally aligned locking surface. The transverse extension of horizontally aligned locking surfaces of this type is approx. 0.05 to 1.0 mm. The dimensioning must be so small in order for the joining of two panels to remain possible at all. However, this inevitably means that only low, vertically aligned forces can be absorbed, so that production must be carried out with extremely low tolerances, in order to ensure that the connection does not spring open with normal stress in the case of even slight irregularities in the floor and/or soft subfloors.

The unpublished application DE 10 2007 015 048.4 describes a panel in which the locking is effected in the vertical direction through a spring element moveable in the horizontal direction. With a joining movement, the spring element snaps behind a locking edge extending essentially in the horizontal direction. The spring element is embodied from the core through a horizontal and vertical cut and connected to the core on at least one of its two ends. The horizontal and vertical cut renders possible the spring movement of the spring element necessary for the production of the locking.

However, this locking is not suitable for thinner panels with a board thickness of approx. 4 mm to 8 mm.

Based on this problem, the panel described at the outset is to be improved.

SUMMARY OF THE INVENTION

To solve the problem, a generic panel is characterized in that the at least one spring element (6) is embodied from the core (3) in one piece and that at least one spring element is embodied on the lower locking section.

Firstly, the production is considerably simplified through this embodiment. The adjustment of the tolerances of different components is omitted. Production times and costs are reduced, because it is not necessary to assemble and join different components. For the end user, it is furthermore ensured that no components are missing and work cannot be continued.

Another advantage lies in that due to the laying of the spring element on the lower locking section, the horizontal slot to expose the spring element from the core is omitted. The moveable spring element can thus have a greater vertical extension, whereby the rigidity and strength of the panel connection is improved. Furthermore, the greater vertical extension of the moveable spring element compared to the board thickness renders possible a secure connection of thin panels with board thicknesses of approx. 4 mm to 8 mm.

Preferably the at least one spring element is free in the direction of the side edge lying opposite with respect to the core and connected to the core in the direction of its side edge on at least one of its ends, in particular at both of its ends. The spring elasticity can be adjusted through the size of the effective connection of the spring element to the core.

The exposure of the spring element with respect to the core is preferably carried out by means of an essentially vertical slot. Through the width of the slot the thickness of the connection of the spring element to the core material can be determined and a stop in the horizontal direction for the spring element can be created so that this is securely protected from overextension.

According to the invention, it is provided that the essentially vertical slot is formed at least in part through the lower locking section. This means that the slot does not need to be embodied over the entire length as a cutout, but can be embodied at its ends as a gap in particular in transition areas. The gap in the transition area is expediently opened towards the underside of the panel and closed towards the top side of the panel. This renders possible a simple and cost-effective production, because the panel can be moved at a constant speed over a milling tool and only the penetration depth of the milling tool into the panel needs to be changed. A transition area can be embodied on one or on both ends of the spring element. The gap can have a variable depth, for example, a uniformly increasing depth.

Preferably the essentially vertical slot is embodied in the area of the hook element of the lower locking section. In the area of the hook element, the locking section expediently has a maximum vertical extension, so that in this area the spring element can be embodied with a correspondingly large vertical extension. With increasing vertical extension of the spring element, the rigidity thereof is also increased.

When a plurality of spring elements spaced apart from one another is provided over the length of the side edge, the stability of the connection is increased, because the free spring deflection in the longitudinal direction of the spring element is limited. The spacing between the individual spring elements can be selected to be larger or smaller. The smaller the spacing, the greater the effective area with which the locking is carried out of course, so that the transferable forces in the vertical direction are correspondingly high.

When the outer edge of the spring element is inclined at an (acute) angle, preferably at an angle between 40° and 50°, to the top side, the joining movement is facilitated, because with increasing movement the spring element deflects deeper in the direction of the panel core. Furthermore, the danger is reduced of the spring element being damaged during the joining movement.

The hook element on the upper locking section is preferably formed by a shoulder aligned in the direction of the underside of the panel. The hook element on the lower locking section is preferably formed by a shoulder aligned in the direction of the top side of the panel.

The embodiment according to the invention of the spring element is suitable in particular for thin panels. Thin panels mean those with a board thickness of approx. 4 mm to approx. 8 mm. Preferably a board thickness of approx. 7 mm or approx. 8 mm is selected.

BRIEF DESCRIPTION OF THE DRAWINGS

Exemplary embodiments of the invention are described below by aid of drawings. The drawings show.

DETAILED DESCRIPTION OF THE PRESENT INVENTION

Figure 1:
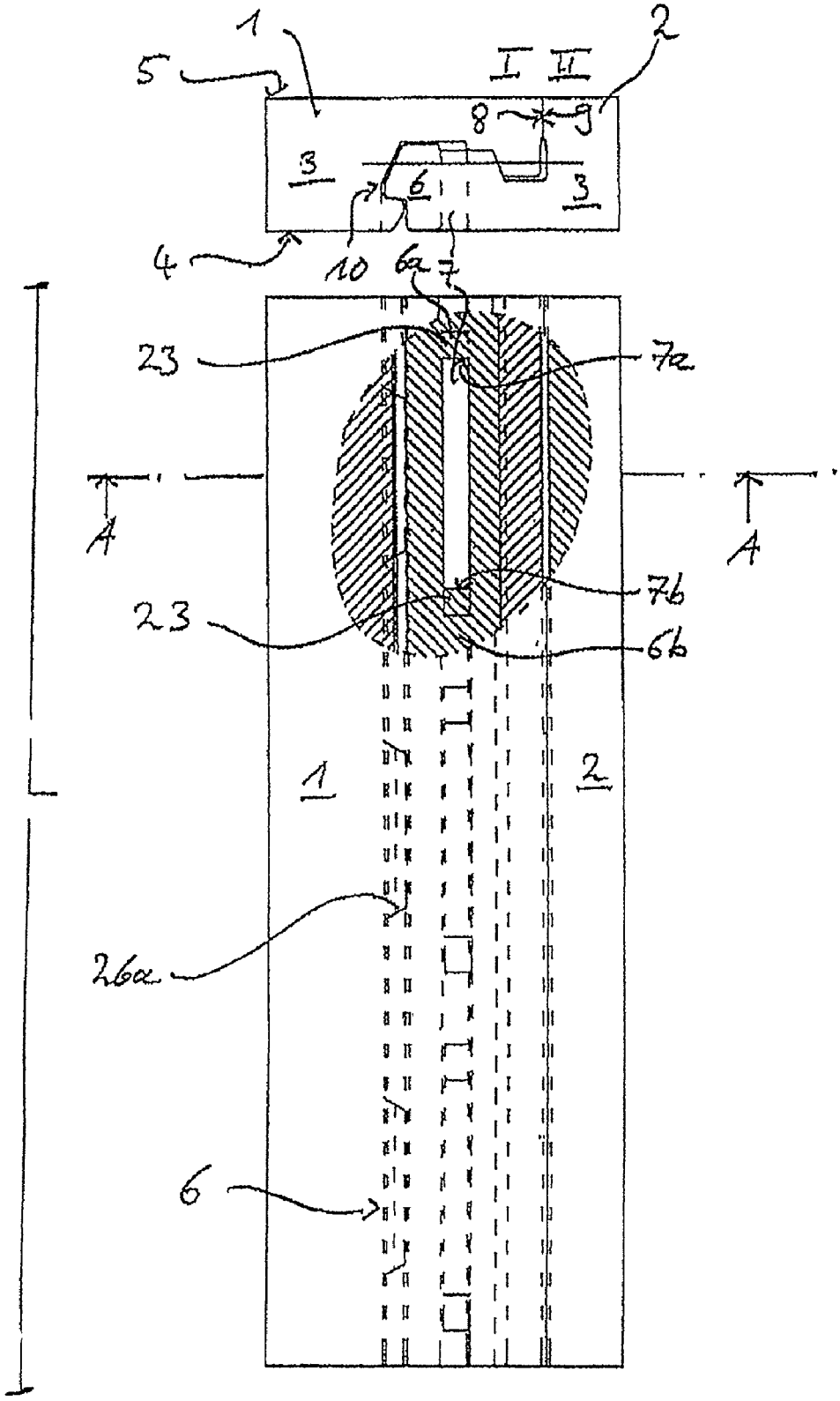
FIG. 1 shows a plan view of two panels connected to one another.

The panels 1, 2 are embodied identically. They comprise a core 3 of wood material or a wood material/plastic mixture. The panels 1, 2 are profiled on their side edges I, II lying opposite one another, wherein the side edge I of the underside 4 and the side edge II of the top side 5 have been machined by milling.

Three spring elements 6 are embodied on the side edge II. The spring elements 6 are identical, so that one of the spring elements 6 is described by way of example below. However, it is not necessary for the tongue elements 6 to be embodied identically.

The spring element 6 was produced by milling out the core 3, in that a slot 7 with ends 7*a*, 7*b* running essentially vertically was milled. The side edges I, II have the length L. In the longitudinal direction of the side edge II, the spring element 6 is connected to the core material with its ends 6*a*, 6*b*. The milling out of the spring element 6 from the core 3 is carried out exclusively through the slot 7. The outer edge 6*c* of the spring element 6 is inclined at an angle $\alpha$ with respect to the top side 5 of the panel 2. The vertical surfaces of the side edges I, II are machined such that contact surfaces 8, 9 are formed in the area of the top side 5.

The panel 1 is provided with a groove 10 extending essentially in the horizontal direction H on the side edge I lying opposite the spring element 6. The groove 10 extends over the entire length L of the side edge I. However, it would be sufficient to provide grooves 10 of sufficient length only in sections corresponding to the spring elements 6 along the side edge I. The upper groove cheek 11 of the groove 10 forms an essentially horizontal locking edge. From the figures it can be seen that the groove base 12 of the groove 10 runs essentially parallel to the outer edge 6*c* of the spring element 6, which facilitates the production of the groove 10. However, it could also be embodied in the vertical direction or at an angle deviating from the angle $\alpha$.

The locking of the two panels 1, 2 in the horizontal direction is carried out via a step profiling of hook elements 13, 14 produced by milling. The hook element 13 is part of an upper locking section 15. The hook element 14 is part of a lower locking section 16.

The hook element 13 has a step-shaped shoulder 17 with two steps 18*a*, 18*b* extending in the direction of the underside. The hook element 14 has a step-shaped shoulder 19 with two steps 20*a*, 20*b* extending in the direction of the top side. The step 18*a* has an essentially planar horizontal contact surface 21, which interacts with an essentially planar horizontal contact surface 22 of the step 20*a* of the hook element 14. The contact surfaces 21, 22 form an essentially horizontal plane E (FIG. 5) so that the panels 1, 2 connected to one another are supported on one another.

The profiling of the hook elements 13, 14 is selected such that a prestressing is generated in the connection point and the vertical contact surfaces 8, 9 of the panels 1, 2 are pressed onto one another so that no visible gap forms on the top side 5. In order to facilitate the joining of the panels 1, 2, the step-shaped shoulder 13 of the upper locking section 15 and the step-shaped shoulder 14 of the lower locking section 16 are milled or rounded on their edges.

In FIG. 1 six transition areas 23 are discernible. Respectively two transition areas 23 are arranged on the ends 7*a*, 7*b* of a slot 7 and based on the line A-A embodied essentially with mirror symmetry. In the present example, the transition areas 23 are embodied as gaps with essentially uniformly decreasing depths (not discernible in the figures). A transition area 23 thereby has the greatest depth at the end that is facing towards the slot 7 and the smallest depth at the end that is guided in the underside of the panel 2.

Figure 2:
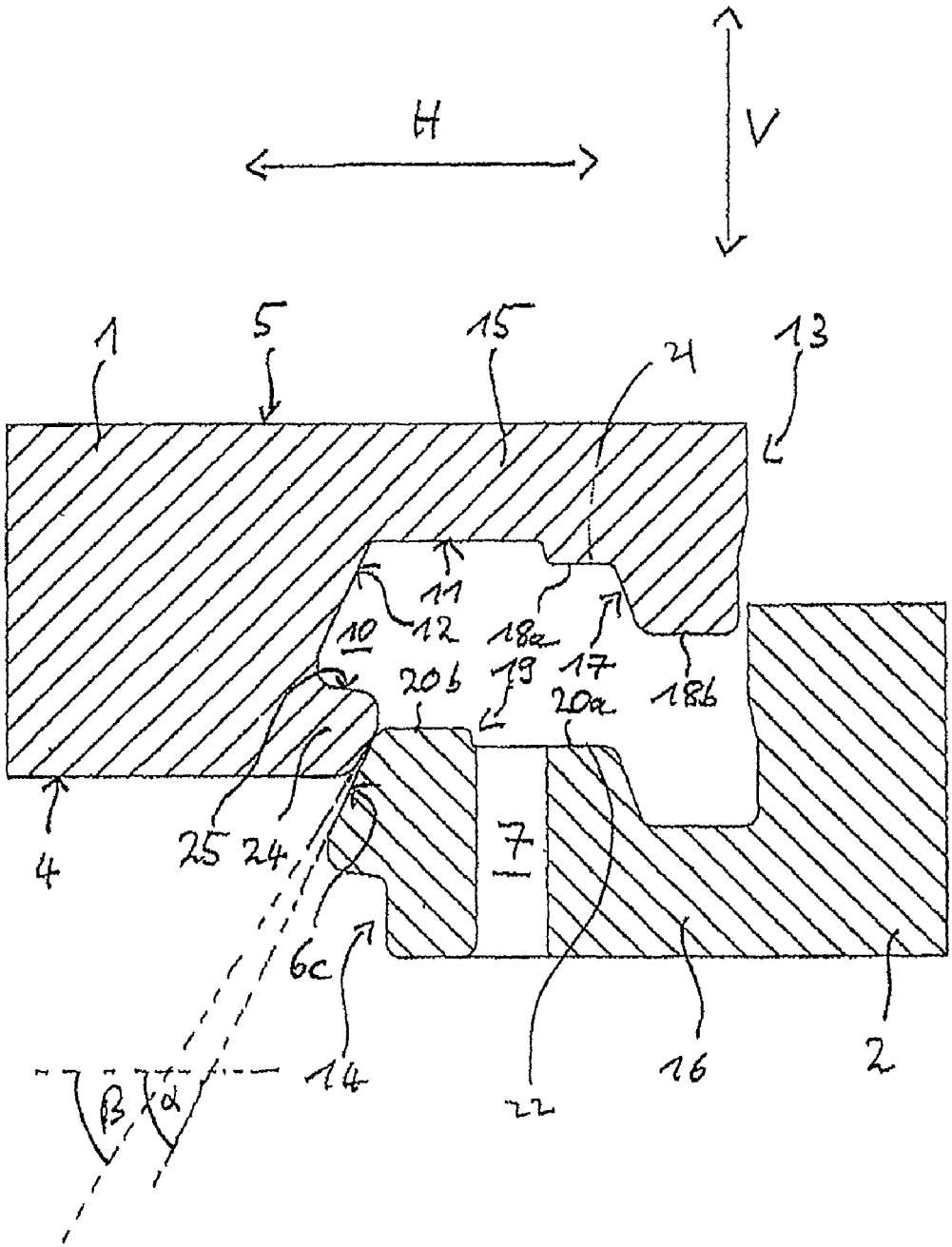
FIGS. 2, 3, 4, and 5 show the two panels from FIG. 1 in partial section at four consecutive times during a joining movement.
Figure 3:
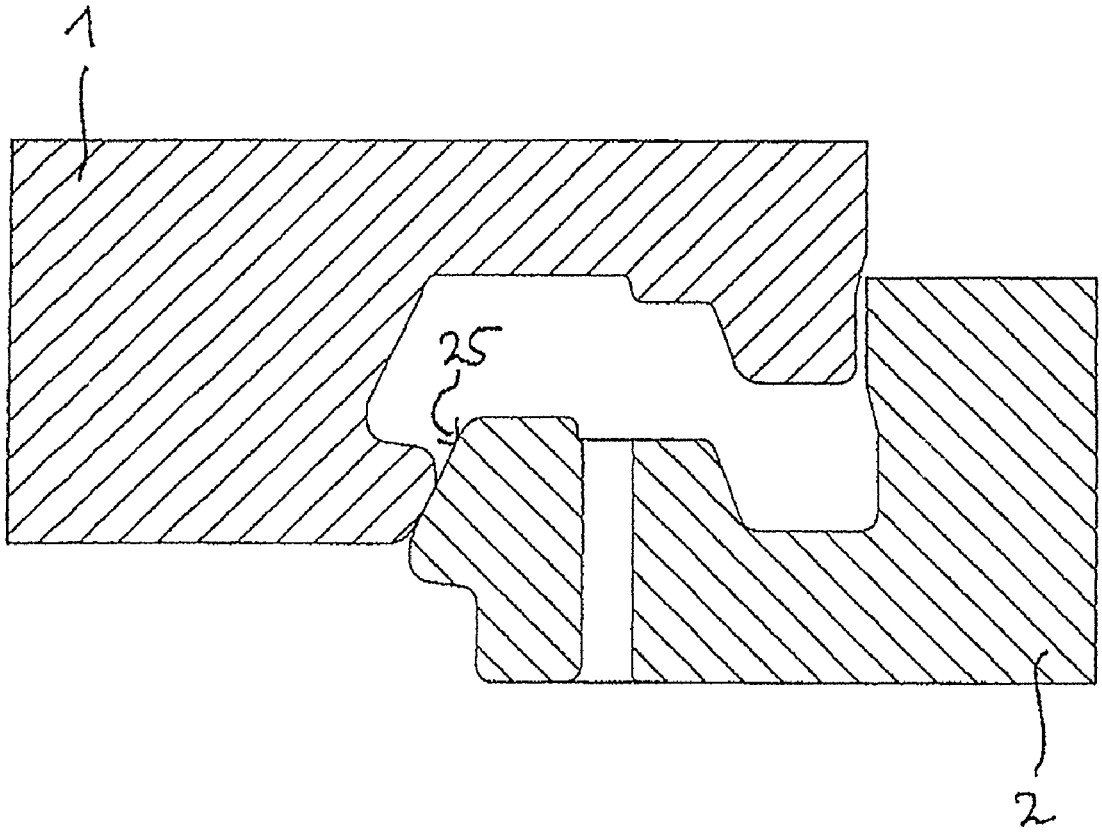
Figure 4:
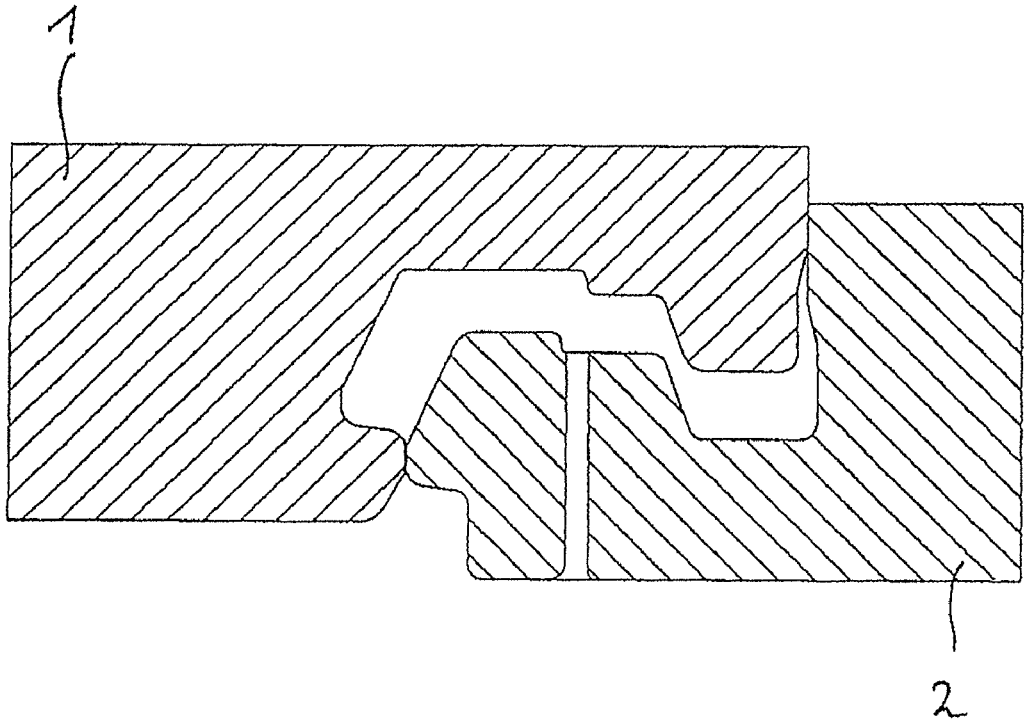

A projection 24 of the panel 1 is discernible in FIG. 2. The projection 24 is aligned essentially horizontally in the direction of the panel 2. The projection 24 has an edge 25 level in sections, which in a lower section runs at an angle β to the top side 5, in a central section runs essentially perpendicular and in an upper section 26 runs essentially horizontally. The upper section 26 forms a groove cheek of the groove 10. The projection 24 has in plan view beveled edges 26*a* (FIG. 1) in order to reduce the danger of damage during locking of the panels 1, 2.

During the joining movement, the spring element 6 is horizontally displaced in the direction of the slot 7 by the impact with the projection 24. During this displacement, a tension builds up in the spring element 6 through the connection with the core 3 at the ends. The slot width is reduced thereby. This tension allows the spring element to snap in the last section of the joining movement (FIG. 5) into the groove 10, that means that the spring element 6 is horizontally displaced in the direction of the groove 10. The horizontal displacement takes place as elastic recovery into a corresponding position under the action of an internal tension. The slot width thereby increases again. The groove 10 is dimensioned such that the spring element 6 can adopt its original position. The groove 10 is milled somewhat deeper in the core 3 than would be necessary to accommodate the spring element 6. This facilitates the laying of the panels 1, 2.

The slot 7 has a height of approx. 60% of the board thickness. This makes it possible to use the locking according to the invention in the vertical direction even with thin panels with board thicknesses of approx. 4 mm to approx. 8 mm. The locking in the vertical direction according to the invention, however, can also be advantageously used with thicker panels, for example, with board thicknesses of approx. 12 mm.

Figure 5:
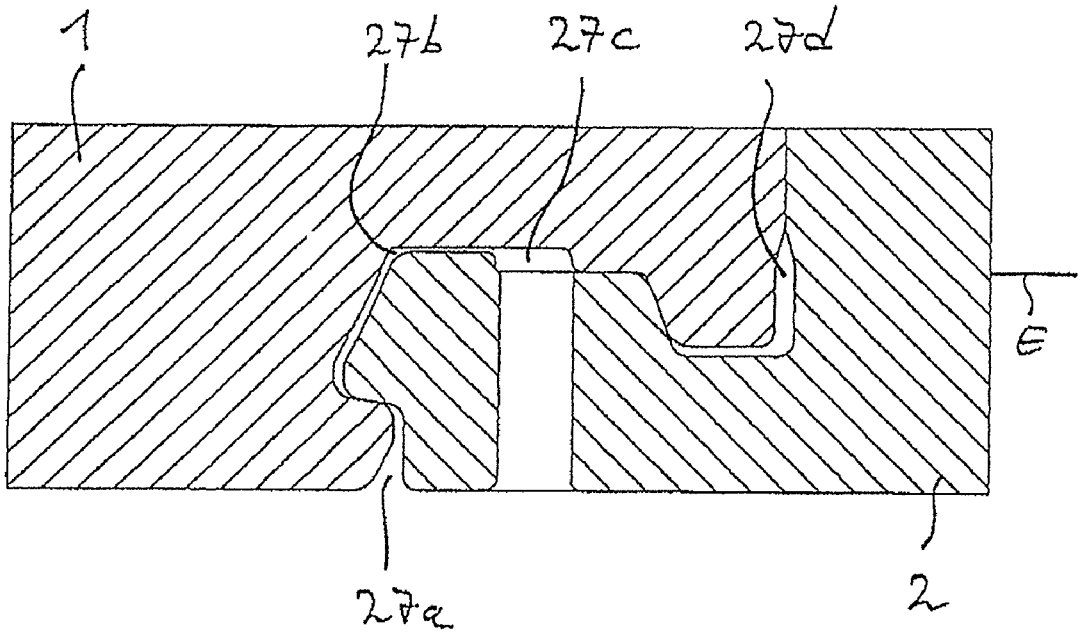
Figure 6:
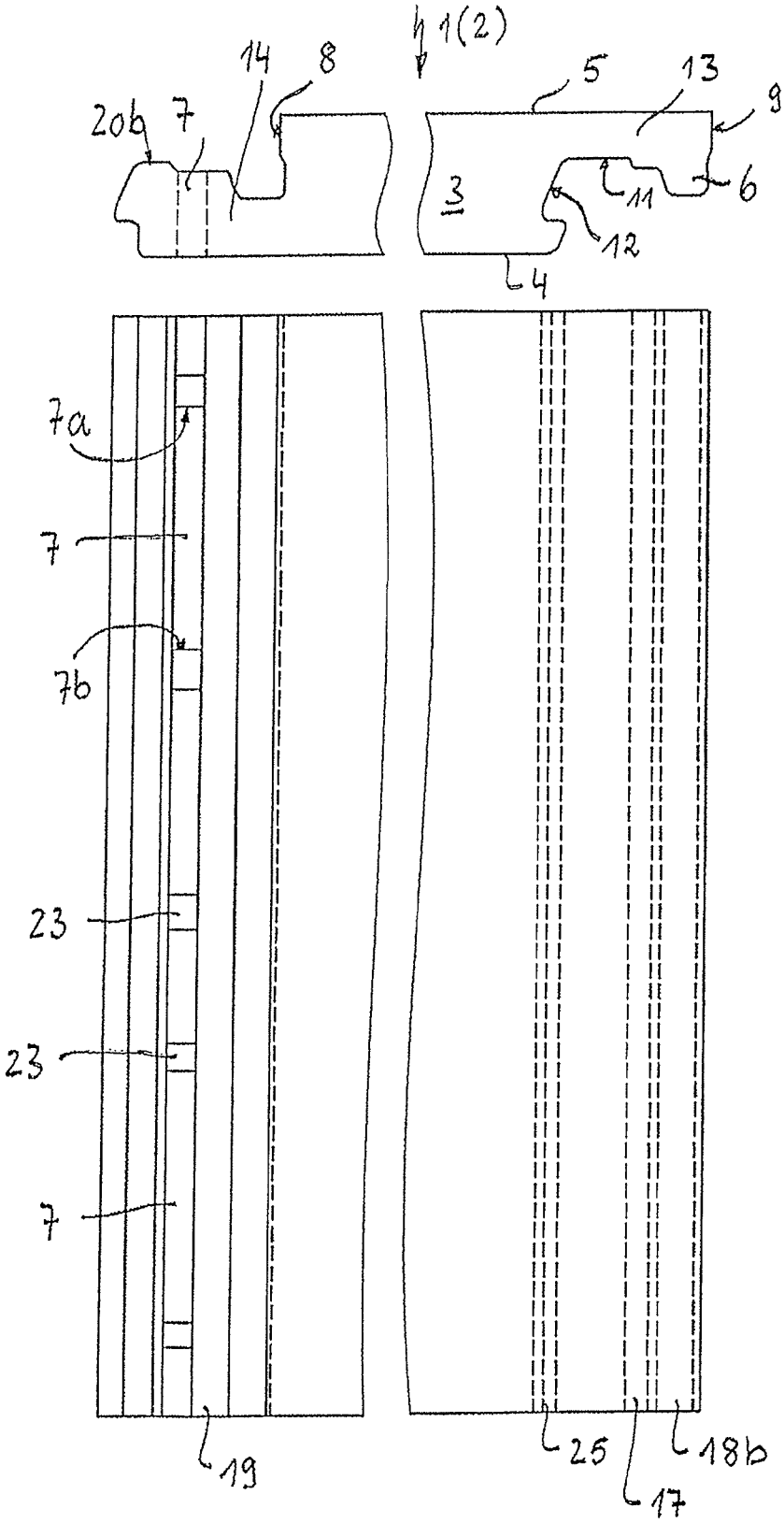
FIG. 6 shows a plan view of a single panel of FIG. 1.

FIG. 5 shows that free spaces 27*a*, 27*b*, 27*c*, 27*d* are provided with the laid panels 1, 2 in the area of the side edges I, II. The free spaces 27*a*, 27*b*, 27*c*, 27*d* provide the freedom of movement necessary for the laying and counteract any manufacturing tolerances occurring.

The exposure of the spring element 6 by the vertical slot is rendered possible by a tool that is transversely displaceable to the machining direction. The machining is thereby preferably carried out in continuous operation, so that respectively one transition area 23 results at the beginning and at the end of the slot 7.

As tools, a milling tool, a laser tool or a water jet tool or also upright blades or broaches can be used. In the exemplary embodiment shown in the Figures, only a displaceable tool is necessary. The area not exposed, which connects the spring element 6 to the core 3 in one piece, is reduced during the machining. Locking forces of different strength can also be adjusted thereby. The locking is releasable with the exemplary embodiment, in that the panels 1, 2 are displaced relative to one another along the side edges I, II or in that a release pin (not shown) is inserted laterally into the connection point.

What is claimed is:

1. A method of forming a panel having a core of a wood material or wood material/plastic mixture and a top side and an underside, the method comprising:

forming a profile corresponding to one another on at least a first side edge and a second side edge lying opposite one another, such that two identically embodied panels can be joined and locked to one another through an essentially vertical joining movement in a horizontal (H) and vertical (V) direction;

forming a hook connection with an upper locking section having a hook element and a lower locking section having a hook element which effects the locking in the horizontal direction;

forming at least one spring element movable in the horizontal direction which effects the locking in the vertical direction (V), wherein during joining movement the at least one spring element snaps in behind a locking edge extending essentially in the horizontal direction (H), wherein:

the at least one spring element is:

embodied from the core in one piece, embodied on the lower locking section, and free in the direction of the first side edge lying opposite by an essentially vertical slot with respect to the core and connected to the core in the direction of the second side edge on at least one of two ends, and the panel is moved at a constant speed when the essentially vertical slot is formed.

2. The method of forming the panel according to claim 1, wherein the at least one spring element is formed so that it is connected to the core on one of the two ends.

3. The method of forming the panel according to claim 2, wherein the essentially vertical slot is formed at least through the lower locking section.

4. The method of forming the panel according to claim 1, wherein the essentially vertical slot is formed in an area of the hook element of the lower locking section.

5. The method of forming the panel according to claim 1, wherein the at least one spring element is formed as a plurality of spring elements spaced apart from one another provided over a length (L) of the second side edge.

6. The method of forming the panel according to claim 1, wherein an outer edge of the at least one spring element is formed at an inclined angle (α) with respect to the top side.

7. The method of forming the panel according to claim 1, wherein the hook element is formed on the lower locking section through a shoulder projecting in a direction of the top side and the hook element is on the upper locking section by a shoulder aligned in the direction of the underside.

8. The method of forming the panel according to claim 1, wherein the panel is formed with a board thickness of approximately 7 mm to approximately 8 mm.

9. The method of forming the panel according to claim 1, wherein the panel is formed as a floor panel.

10. The method of forming the panel according to claim 1, wherein the essentially vertical slot is formed at its ends as a gap in transition areas.

11. The method of forming the panel according to claim 10, wherein the gap in the transition areas is formed so that it is opened towards the underside of the panel and closed towards the top side of the panel.

12. The method of forming the panel according to claim 11, wherein the panel is moved at a constant speed over a milling tool and only a penetration depth of the milling tool into the panel needs to be changed.

13. The method of forming the panel according to claim 11, wherein the gap is formed to have a variable depth.

14. The method of forming the panel according to claim 13, wherein the variable depth is a uniformly increasing depth.

15. A method of forming a panel having a core having a first side edge and second side edge lying opposite one another, the method comprising:

forming a plurality of spring elements embodied on the second side edge and each being identical, the plurality of spring elements formed to include ends, an outer edge, and a slot running through the core, the plurality of spring elements being formed so as to connect to the core with the ends in a longitudinal direction of the second side edge, and the outer edge of the spring element being formed inclined at an angle $\alpha$ with respect to a top side of the panel;

forming a groove extending essentially in a horizontal direction H on the first side edge, lying opposite the plurality of spring elements, and extending over a length L of the first side edge, wherein the groove:

is dimensioned such that the plurality of spring elements adopt its original position once inserted therein;

is deeper in the core than necessary to accommodate the plurality of spring elements;

includes an upper groove cheek which forms an essentially horizontal locking edge; and includes a groove base that runs essentially parallel to an outer edge of the plurality of spring elements or at an angle deviating from the angle $\alpha$;

a first hook element on an edge of the first side edge adjacent to the top side, the first hook element being part of an upper locking section and including:

a stepped surface comprising an upper portion on an outer plane and an inner portion on an inner plane with a shoulder therebetween, a step-shaped shoulder with two steps extending in a direction of an underside of the panel;

forming a second hook element on an edge of the second side edge adjacent the underside, the second hook element being part of a lower locking section, the second hook element being formed to comprise a step-shaped shoulder with two steps extending in the direction of the top side, wherein surfaces of the two steps of the first hook element and the second hook element interact to form a horizontal plane E when corresponding panels are joined, forming transition areas arranged on the ends of the slot, the transition areas being embodied as gaps with essentially uniformly decreasing depths such that a greatest depth is at an end that is facing towards the slot and a smallest depth is at an end that is guided in the underside; and forming a projection extending from the groove, the projection being formed to have an edge, which in a lower section runs at an angle $\beta$ to the top side, in a central section runs essentially perpendicular and in an upper section runs essentially horizontally, wherein the upper section forms a groove cheek of the groove, wherein:

the panel is moved at a constant speed when the slot is formed.

16. The method of forming the panel according to claim 15, wherein the slot is formed to have a height of approximately 60% of a board thickness.

17. The method of forming the panel according to claim 15, wherein the panel is formed to have a thicknesses of approximately 4 mm to approximately 8 mm.

18. The method of forming the panel according to claim 15, further comprising forming free spaces provided with laid panels in an area of the first and second side edges, the free spaces providing freedom of movement necessary for the laying and counteracting manufacturing tolerances.

19. The method of forming the panel according to claim 15, wherein the slot is formed at least in part through the lower locking section.

20. The method of forming the panel according to claim 15, wherein the gap in the transition areas is formed so that it is opened towards the underside of the panel and closed towards the top side of the panel.

21. The method of forming the panel according to claim 20, wherein the gap is formed to have a variable depth.

22. The method of forming the panel according to claim 15, wherein the panel is moved at a constant speed over a milling tool and only a penetration depth of the milling tool into the panel needs to be changed.

23. The method of forming the panel according to claim 15, wherein the panels are formed such that:

during joining movement of the panel, the plurality of spring elements are configured and structured to be horizontally displaced in a direction of the slot by impact with the projection, during the displacement, the plurality of spring elements are configured and structured to have a tension build up through a connection with the core at the ends such that a width of the slot is reduced, and the tension allows the plurality of spring elements to snap in a last section of the joining movement into the groove such that the horizontal displacement takes place as elastic recovery into a corresponding position under the action of an internal tension such that the slot width thereby increases.

* * * * *